US006744455B2

(12) United States Patent
Coons et al.

(10) Patent No.: US 6,744,455 B2
(45) Date of Patent: Jun. 1, 2004

(54) METHOD AND APPARATUS FOR THERMAL MANAGEMENT IN A THERMAL PRINTER HAVING PLURAL PRINTING STATIONS

(75) Inventors: David E. Coons, Webster, NY (US); Frederic J. Sturgis, Pittsford, NY (US); Raymond Maynard, Wakefield, RI (US); David A. Johnson, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 28 days.

(21) Appl. No.: 10/080,115

(22) Filed: Feb. 21, 2002

(65) Prior Publication Data

US 2003/0156182 A1 Aug. 21, 2003

(51) Int. Cl.[7] ..... B41J 2/38
(52) U.S. Cl. ..... 347/189
(58) Field of Search ..... 347/189, 223, 347/18, 242, 171, 173; 400/120.01, 120.04, 120.14, 124.13, 719

(56) References Cited

U.S. PATENT DOCUMENTS 5,125,630 A * 6/1992 Hoyt et al. ..... 242/532.6
5,192,958 A 3/1993 Charnitski ..... 347/242
5,231,423 A 7/1993 Wataya et al. ..... 347/18
5,374,944 A 12/1994 Janosky ..... 347/223
5,440,328 A 8/1995 Nardone et al. ..... 347/173
5,486,849 A 1/1996 Miura et al. ..... 347/18
5,631,676 A 5/1997 Karz ..... 347/18
6,113,212 A 9/2000 Ng ..... 347/18
6,493,018 B1 * 12/2002 Hevenor et al. ..... 347/217

* cited by examiner

*Primary Examiner*—Lamson Nguyen
*Assistant Examiner*—K. Feggins
(74) *Attorney, Agent, or Firm*—Norman Rushefsky

(57) ABSTRACT

A method and apparatus for recording image information on a moving receiver media at a thermal print station features a ribbon cassette assembly that stores a thermal ribbon having dye, the thermal ribbon being supported as a supply role and take-up role on the ribbon cassette assembly, the ribbon cassette assembly including a wall structure defining a plenum chamber. Air under pressure is provided to the plenum chamber. An elongated thermal print head is positioned in engagement with the thermal ribbon; and recording elements on the thermal print head are directed along a main scan direction. The print head has associated therewith a heat sink that includes a series of parallel fins arranged along the length of the print head and the fins are oriented at least generally perpendicular to the main scan direction of printing. Cooling air flows from the wall structure, which structure extends in the direction of elongation of the print head. The wall structure has one or more openings along the direction of elongation, the cooling air being directed generally to sweep in the direction of the fins so that the cooling air advances generally in a direction generally parallel to the advancement direction of the receiver media at the printing station.

10 Claims, 18 Drawing Sheets

METHOD AND APPARATUS FOR THERMAL MANAGEMENT IN A THERMAL PRINTER HAVING PLURAL PRINTING STATIONS

BACKGROUND ON THE INVENTION

1. Field of the Invention

The present invention relates to apparatus and methods for controlling temperature of printheads in a thermal printer apparatus. More particularly, the present invention is directed to thermal printer apparatus and methods having a thermal print engine that comprises plural printing stations.

2. Description Relative to the Prior Art

In the prior art as represented by U.S. Pat. No. 5,440,328, thermal printer apparatus are known that operate as a single pass, multi-color thermal printer. In such a printer a print engine is provided that comprises a media transport system and three or more thermal print head assemblies. Each of the print head assemblies includes a respective reloadable thermal ribbon cassette which is loaded with a respective color transfer ribbon. Each of the thermal print head assemblies comprises a cantilevered beam, a mounting assembly and a thermal print head having a thermal print line. Each of the print head assemblies has a counterpart platen roller with which a respective print head forms a respective nip and through which the media passes in combination with a respective color ribbon of dye. In lieu of separate platen rollers there may be a single large roller which forms a nip with each of the print heads. The mounting assemblies allow the print heads' positions to be adjusted so that the mounting assemblies can be pivoted towards and away from the respective platen rollers. In this regard, the mounting assemblies are pivotable between an "up" position wherein the print heads are disengaged from the platen rollers and a "down" position wherein the print heads are in biased engagement with the platen rollers.

A problem with thermal printer apparatus of the type described above is the need to reduce waste created when printing must cease due to overtemperature or nonuniform conditions in one of the print heads. Overtemperature conditions may arise due to the requirement of many of the recording elements on a print head for a color to have to record an image at a relatively high density. Thus it is very important that the printer be operating at or below the temperature threshold prior to and throughout the entire printing cycle. It is known that thermal bead temperatures below a certain threshold temperature transfer less amount of dye (color) per transfer unit, usually resulting in low density or light (soft) images. Conversely, thermal bead temperatures above a certain threshold temperature transfer more dye per transfer unit, usually resulting in higher density with darker than desired images. In addition, in order to achieve high-quality photographic looking prints using a thermal printing device (dye diffusions/dye sublimation) it is very important that the distribution along the printing surface or printing line be as uniform as possible when printing a "flat field" image. Also, it is known that for a typical image, one which may not be a "flat field", or gray, the temperature distribution along the bead (or recording line) will vary. Higher temperatures will result with darker image areas and lower temperatures will result in lower density image areas.

It is typical for thermal print engines to preheat a thermal head in some fashion prior to the dye transfer phase of the printing cycle in order to achieve the correct level of dye transfer. Methods of preheating sometimes involve the use of electrically controlled resistive heaters placed between the thermal head and its attached heat sink or, more typically, energizing the recording elements of the thermal head. In either case, the thermal head (bead) temperature is usually determined by the use of a thermistor (or thermocouple) mounted in the thermal head assembly near the thermal bead. Thermistor electrical resistance changes with temperature and is easily monitored by the printer microprocessor.

It is also typical in a thermal printing apparatus to have the thermal head attached to a heat sink (with and without fines) such as aluminum. Some may have a cooling fluid circulated around to maintain proper bead temperature. All for the purpose of minimizing inappropriate amounts of dye transfer associated with the thermal bead being too hot or to cool.

Thermal printing productivity inefficiencies result when the print cycle is delayed due to the heating up or cooling down of the thermal head necessary to achieve the "start print" temperature. In addition, inefficient temperature control management creates undesired density fluctuations within the printer image. Also, and perhaps more importantly, during the printing sequence if the thermal head temperature falls outside the "normal" operating range the printing apparatus must continue to advance the receiver (and donor) media until the entire image has been printed before the next image can be started. It will thus be understood that substantial waste of both paper and dye media can result when the printer apparatus has multiple heads arranged serially along the print path and thus thermal management becomes an important consideration.

It is therefore an object of the invention to improve upon the thermal management in a single pass, multi-color thermal printer.

SUMMARY OF THE INVENTION

In accordance with a first aspect of the invention, there is provided a thermal printer apparatus for recording image information on moving receiver media at a print station, the apparatus comprising a ribbon cassette assembly for storing a thermal ribbon having dye, the thermal ribbon including a supply ribbon core and a take-up ribbon core, the cassette assembly including a supply ribbon support for supporting the supply ribbon core and a take-up ribbon support for supporting the take-up ribbon core, the cassette assembly including a wall structure defining a plenum chamber, the plenum chamber having air under pressure; a fan communicating with the plenum chamber for providing air under pressure to the plenum chamber; an elongated thermal print head positionable in engagement with the thermal ribbon for transferring dye from the thermal ribbon to the moving receiver media, the print head having a plurality of recording elements arranged in a main scan recording direction that is perpendicular to an advancement direction of the moving receiver media, the main scan recording direction also being the direction of elongation of the print head; a heat sink associated with the print head and including a series of parallel fins arranged along the length of the print head and the fins being oriented at least generally perpendicular to the main scan direction, and generally parallel to the advancement direction of the receiver media; and wherein the wall structure extends in the direction of elongation of the print head and has one or more openings along the direction of elongation for providing cooling air directed generally to sweep in the direction of the fins so that the cooling air advances generally in a direction generally parallel to the advancement direction of the receiver media at the print station to enhance cooling of the print head.

In accordance with a second aspect of the invention there is provided

BRIEF DESCRIPTION OF THE DRAWINGS

The invention will be described hereinafter by way of example with reference to the accompanying drawings wherein.

DESCRIPTION OF THE PREFERRED EMBODIMENTS

The invention will be described with reference to a single pass, multicolor thermal printer of the type described in U.S. Pat. No. 5,440,328. In such a printer, a print engine is provided that comprises a media transport system and three or more thermal print head assemblies or print stations. Each of the print head assemblies includes a respective re-loadable thermal ribbon cassette which is loaded with a color transfer ribbon. Each of the thermal print head assemblies comprises a cantilevered beam, a mounting assembly and a thermal print head having a thermal print line. Each of the print head assemblies has a counterpart platen roller with which a respective print head forms a respective nip and through which the media passes in combination with a respective color ribbon of dye. The mounting assemblies allow the print heads' positions to be adjusted so that the mounting assemblies can be pivoted towards and away from the respective platen rollers. In this regard, the mounting assemblies are pivotable between an "up" position wherein the print heads are disengaged from the platen rollers and a "down" position wherein the print heads are in biased engagement with the platen rollers.

The reloadable ribbon cassette assembly comprises a cassette body including a ribbon supply roll and a ribbon take-up roll. The ribbon cassette assemblies are loaded with one of three or more primary color ribbons which are used in conventional subtractive color printing. The supply and take-up rolls of each ribbon cassette assembly are coupled to individual ribbon drive sub-assemblies when the cassette assembly is loaded into the printer for printing images on the media. In addition to an assembly for each of the color ribbons, there may also be provided a ribbon cassette assembly that is provided with a supply of transparent ribbon that can transfer an overcoat layer to the media after an image has been printed thereon. The transparent ribbon cassette assembly is similar in all respects to the other assemblies and a separate print head is used to transfer the overcoat layer to the now imaged receiver. Different types of transparent ribbon may be used to provide matte or glossy finish overcoats to the final print. Alternatively, the print head associated with the transparent ribbon may have the respective recording elements suitably modulated to create different finish overcoats to the final print.

Figure 1:
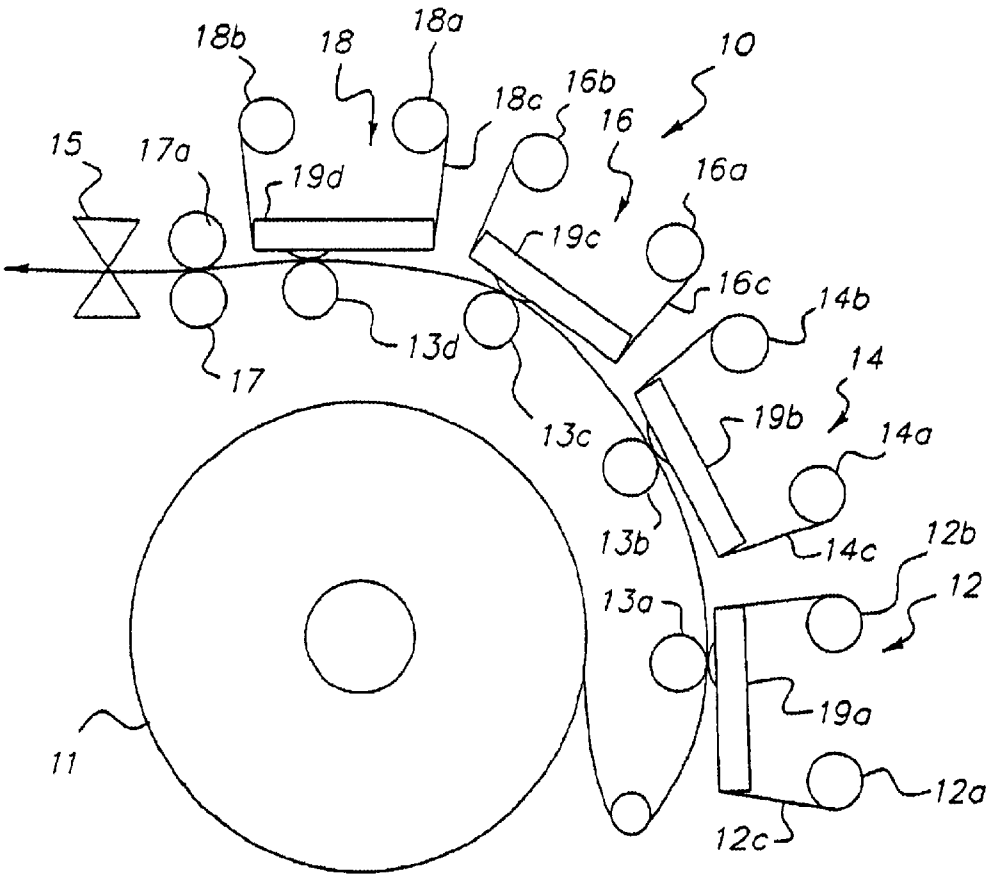
FIG. 1 is a schematic side elevational view of a thermal print engine for use with the invention.

Referring now to the drawings there is illustrated in FIG. 1, a single-pass multicolor thermal print engine 10 that may be used in accordance with the teachings of the instant invention. A receiver media 11 comprising coated paper having a coating thereon for receiving a thermal dye is supported as a continuous roll and threaded about a series of platen rollers 13*a–d*. The receiver media is also threaded through a nip comprised of a capstan drive roller 17 and a backup roller. As the receiver media is driven by the capstan drive roller the receiver media passes by each thermal print assembly 12, 14, and 16 a respective color dye image is transferred to the receiver sheet to form the multicolor image. For example, the assembly 12 may provide a yellow color separation image, the assembly 14 may provide a magenta color separation image, and the assembly 16 may provide a cyan color separation image to form a three color multicolor image on the receiver sheet. A fourth assembly 18 is provided for thermally transferring the transparent overcoat to protect the color image from for example fingerprints. At each of the four assemblies there is provided a thermal print head 19*a–d* that has recording elements selectively enabled in accordance with image information to selectively transfer color dye to the receiver or in the case of the transparent ribbon to transfer the overcoat layer to the now imaged receiver sheet. After each multicolor image is formed, a cutter 15 may be enabled to cut the receiver media into a discrete sheet containing the multicolor image protected by the transparent overcoat layer. As may be seen in FIG. 1 at each thermal print assembly, there is provided a platen roller which forms a respective printing nip with the respective print head 19*a–d*. As the receiver sheet is driven through each of the respective nips, the movement of the receiver sheet advances a corresponding thermal ribbon 12*c*, 14*c*, 16*c* and 18*c* through the respective nip as well. Each thermal ribbon is mounted upon a respective cassette assembly which will be described below and comprises a supply roll (12*a*, 14*a*, 16*a* and 18*a*) and a take-up roll (12*b*, 14*b*, 16*b* and 18*b*).

Figure 2:
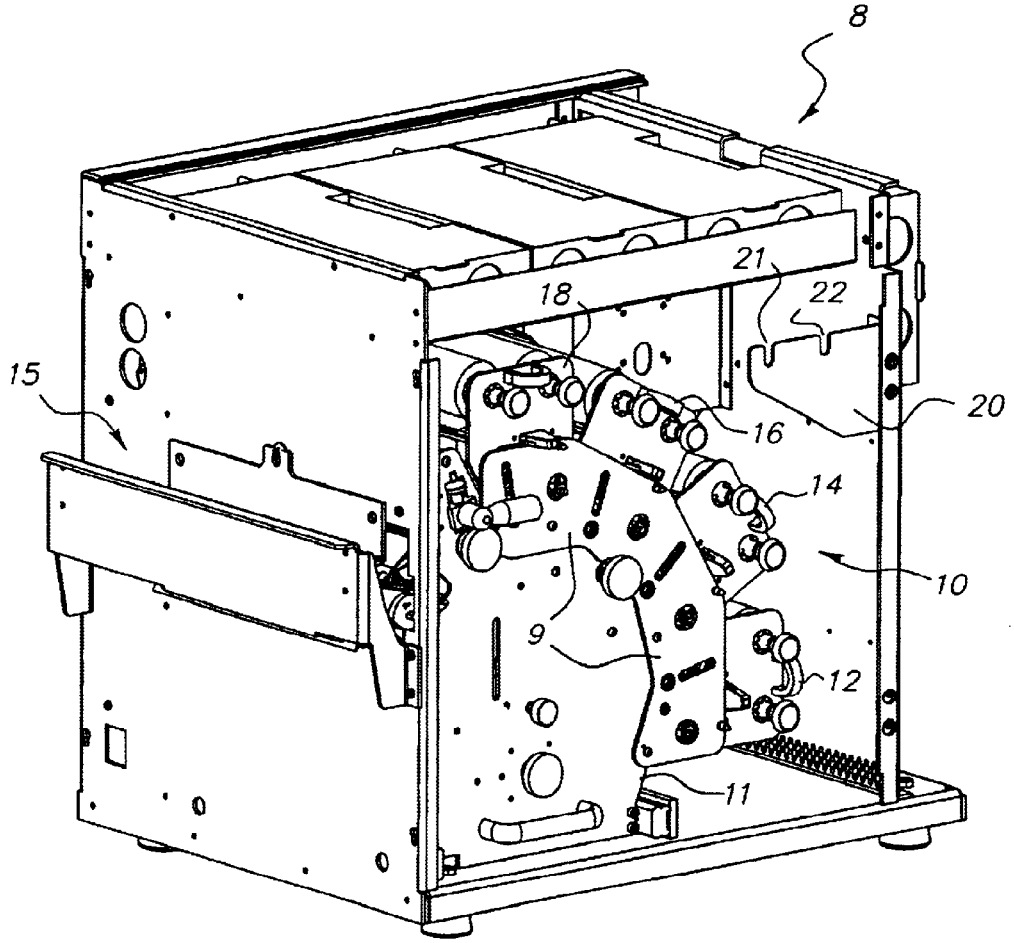
FIG. 2 is a perspective view of a thermal printer that employs the thermal print engine of FIG. 1 and illustrates a loading aid associated with the thermal printer for facilitating loading of supply and take-up ribbon cores onto thermal ribbon cassette assemblies.

With reference now to FIG. 2, there is shown a printer apparatus 8 that includes a housing which encloses the printer engine 10 illustrated in FIG. 1. A front housing door has been removed to illustrate the inside of the printer apparatus so that the various thermal print assemblies 12, 14, 16, and 18 may be seen. A decorative outer housing is also not shown. Supported on one of the sidewalls of the housing so as to be presented at the front opening when the front housing door (not shown) is swung open is a loading aid bracket. As may be noted from FIG. 2, the loading aid bracket comprises a vertically upstanding plate 20 that includes two vertical slots 21, 22 formed in a top edge of the plate.

Figure 3:
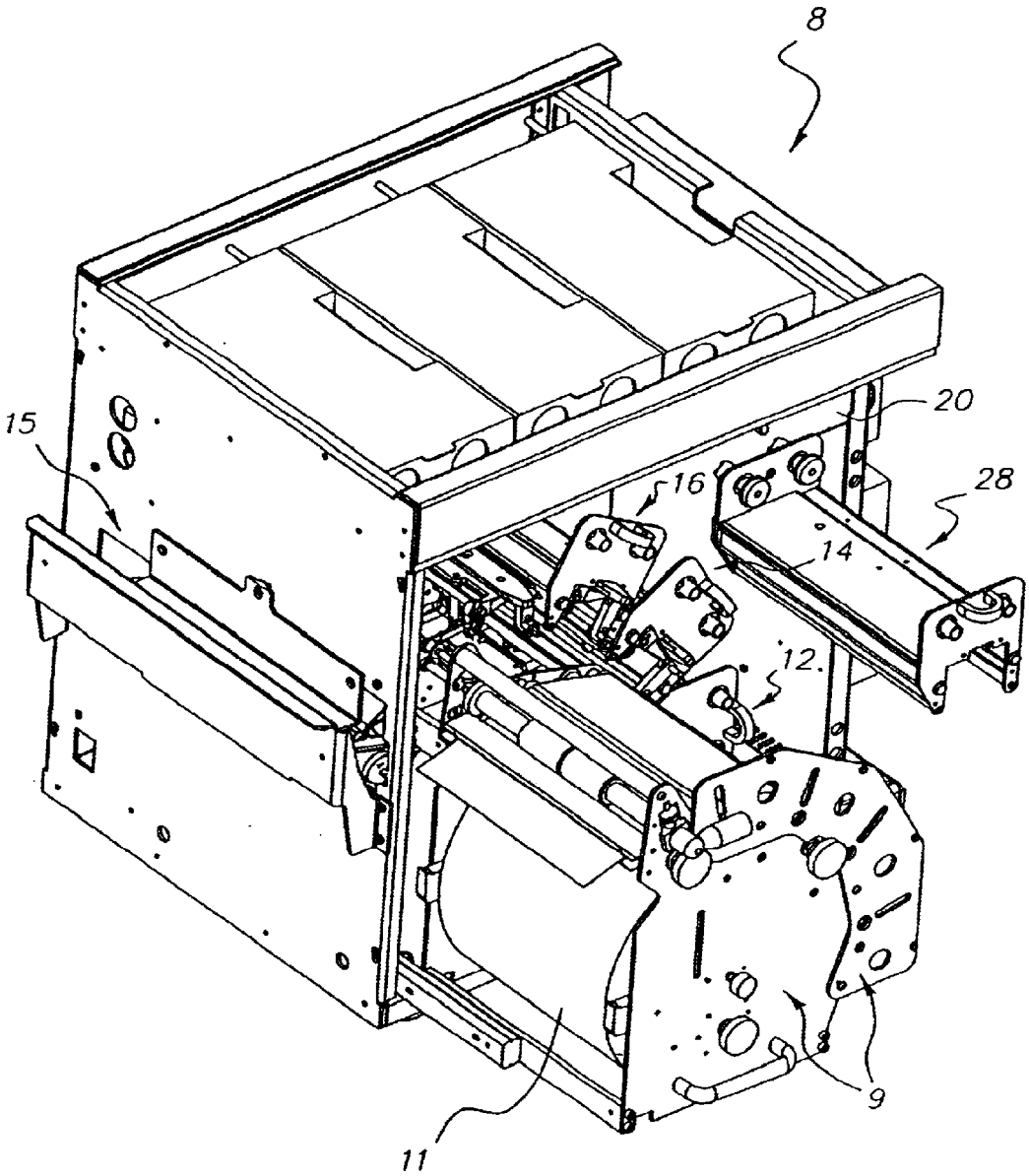
FIG. 3 is a view similar to that of FIG. 2, but illustrating a thermal ribbon cassette assembly removed from its position in a print station of the printer and mounted on a loading aid.
Figure 4:
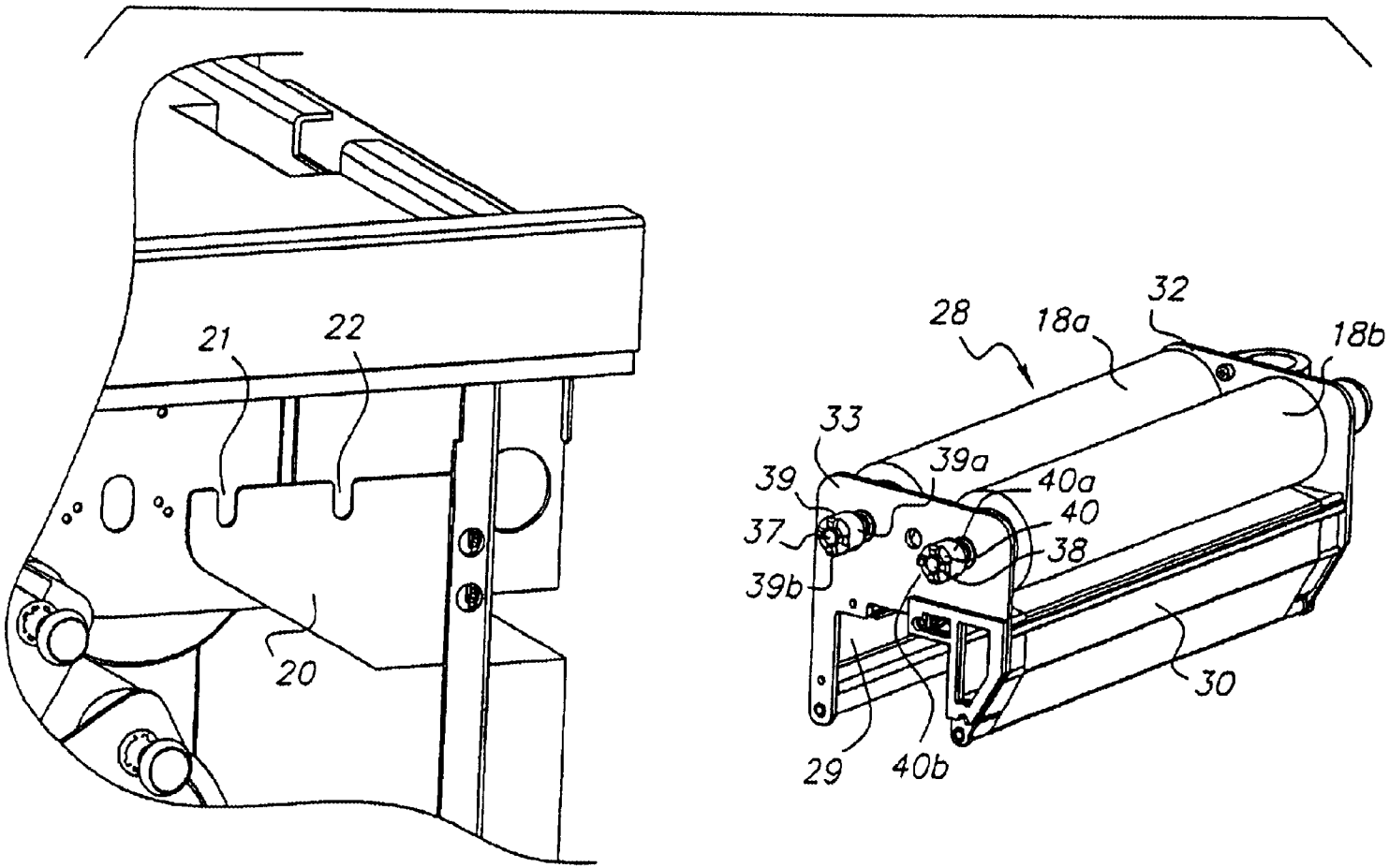
FIG. 4 is a close-up view in perspective of the loading aid and a thermal ribbon cassette assembly.
Figure 6:
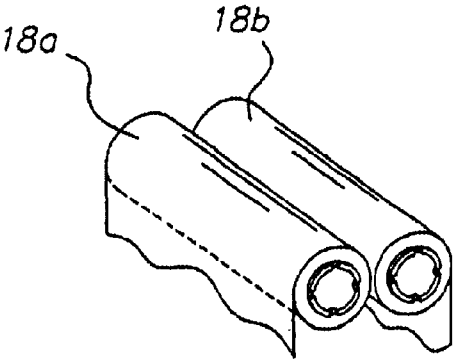
FIG. 6 is a view of the rear end of each of the supply and take-up rolls showing the respective cores with notches.

With reference now to FIG. 3, there is shown a view similar to that of FIG. 2 except that a reloadable ribbon cassette assembly 28 forming a part of one of the thermal print assemblies has been slid forward on a sliding rail and removed from the printer apparatus. In order for the ribbon cassette assembly to be moved forwardly, a platen assembly 9, which includes the support for the roll 11 of paper media and all the drive components for the paper media including platen rollers and capstan roller, is moved forwardly to provide room for sliding movement of any of the ribbon cassette assemblies. With reference now to FIG. 4, there is shown a rear view of the ribbon cassette assembly 28 removed from the printer apparatus and a close-up view of the loading aid bracket 20 that is bolted or welded to the frame of the printer apparatus. The ribbon cassette assembly includes a central extrusion of aluminum having depending right and left sidewalls 29,30 and front and back walls 32,33 that are attached to the aluminum extrusion. In the view of FIG. 4, it may be seen that the supply and take-up rolls 18*a*,18*b* for this particular ribbon are supported on the ribbon cassette assembly. While not shown in FIG. 4 the ribbon would extend from the supply roll 18*a* around the right and left depending sidewalls 29,30 and up to the take-up roll 18*b*. The ribbon cassette assembly includes appropriate supports 35*f*,35*r*,36*f*,36*r* (see also FIG. 7) for supporting each of the supply and take-up rolls on respective supports at the front and back ends thereof. In this regard, each of the supply and take-up rolls may include a core upon which the ribbon material is adapted to be wound. The supports for the respective cores may comprise insert devices each of which engage a respective end of each core and support the core for rotation at that end. The insert devices in the rear may have pins or projections as shown to engage with mating slots formed at the rear end of each of the cores to allow drive of the cores. Such insert devices are well-known in the art. At the rearward end of the ribbon cassette assembly, the insert devices at the rear end are each attached, through a respective shaft 37,38 that extends through respective openings in the backwall 33 and are respectively coupled to respective gears 39, 40. The gears comprise base members 39*a*, 40*a* that have four teeth 39*b*, 40*b* axially projecting therefrom. A space is provide between the base member 39*a*, 40*a* and the backwall 33 that is sufficient sufficient to permit mounting of the shafts 37,38 in the respective slots 21,22 on the loading aid bracket 20.

Figure 5:
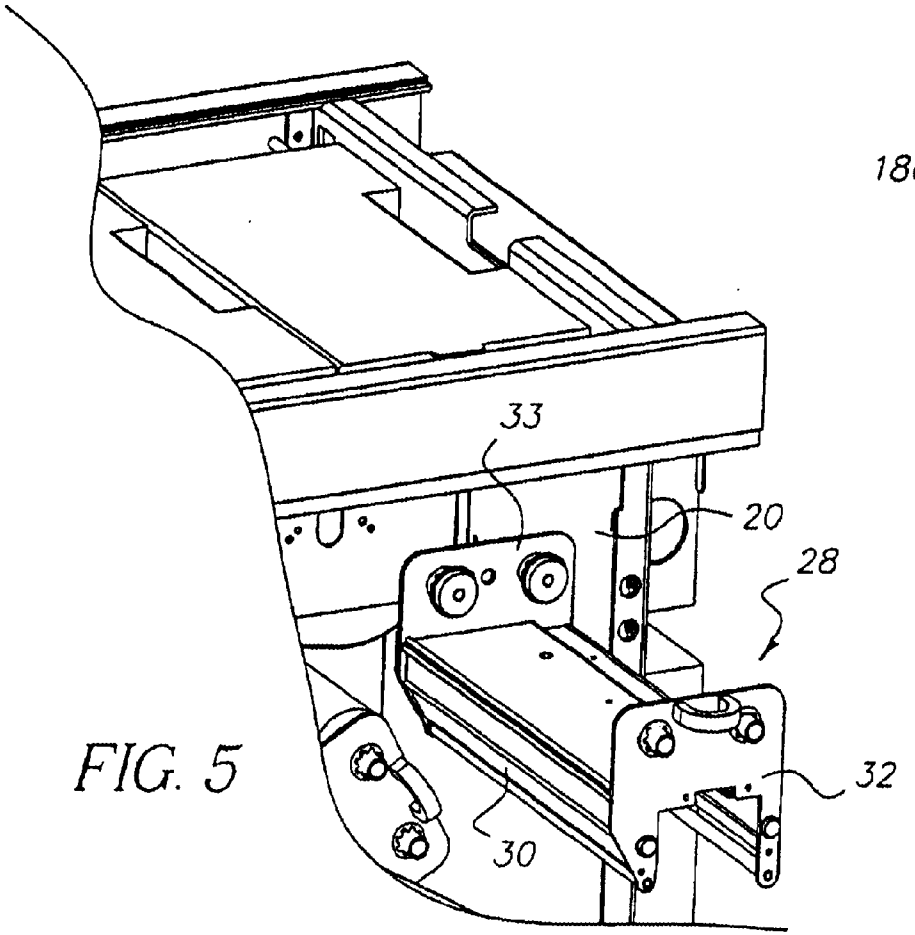
FIG. 5 is a close-up view of the loading aid and illustrating the thermal ribbon cassette assembly mounted on the loading aid.
Figure 7:
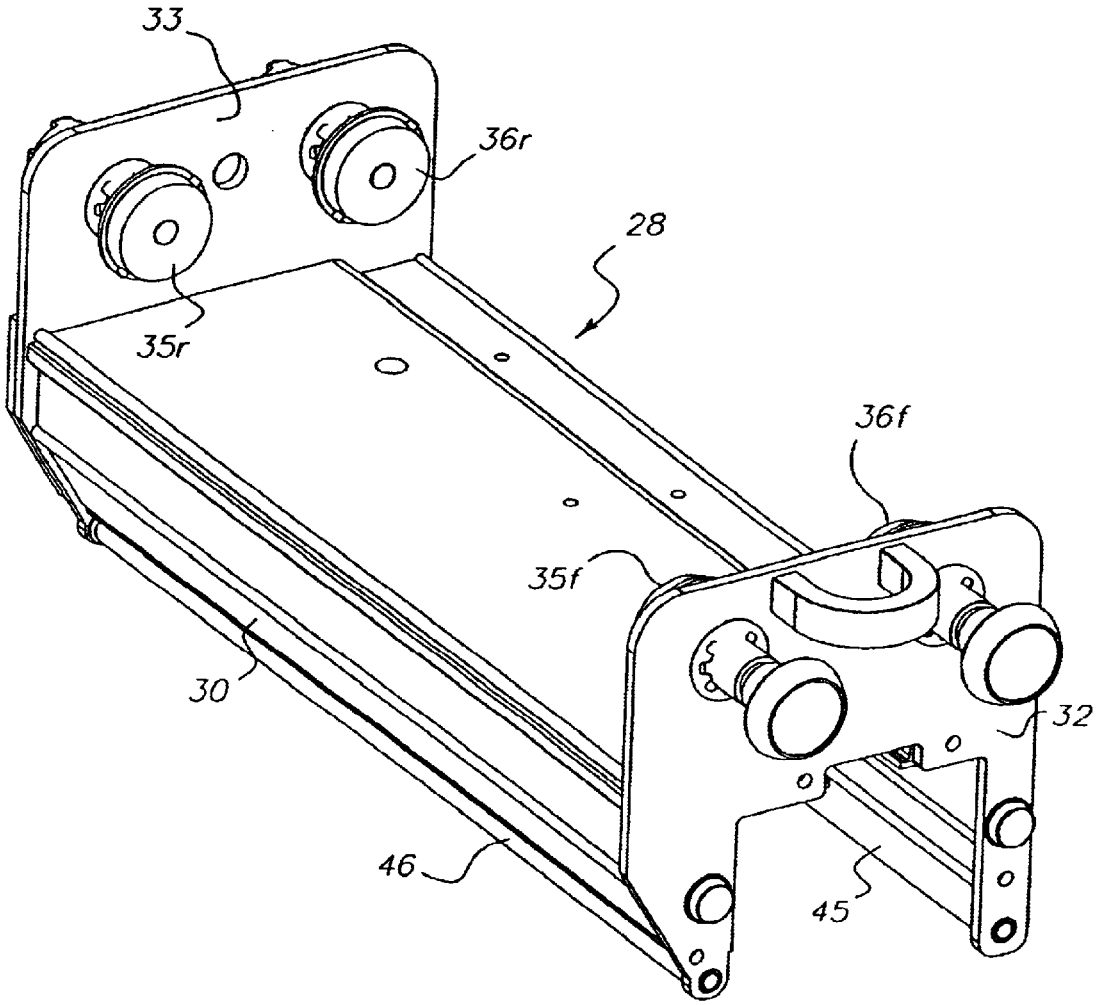
FIGS. 7 and 8 are different perspective views of the thermal ribbon cassette assembly.
Figure 8:
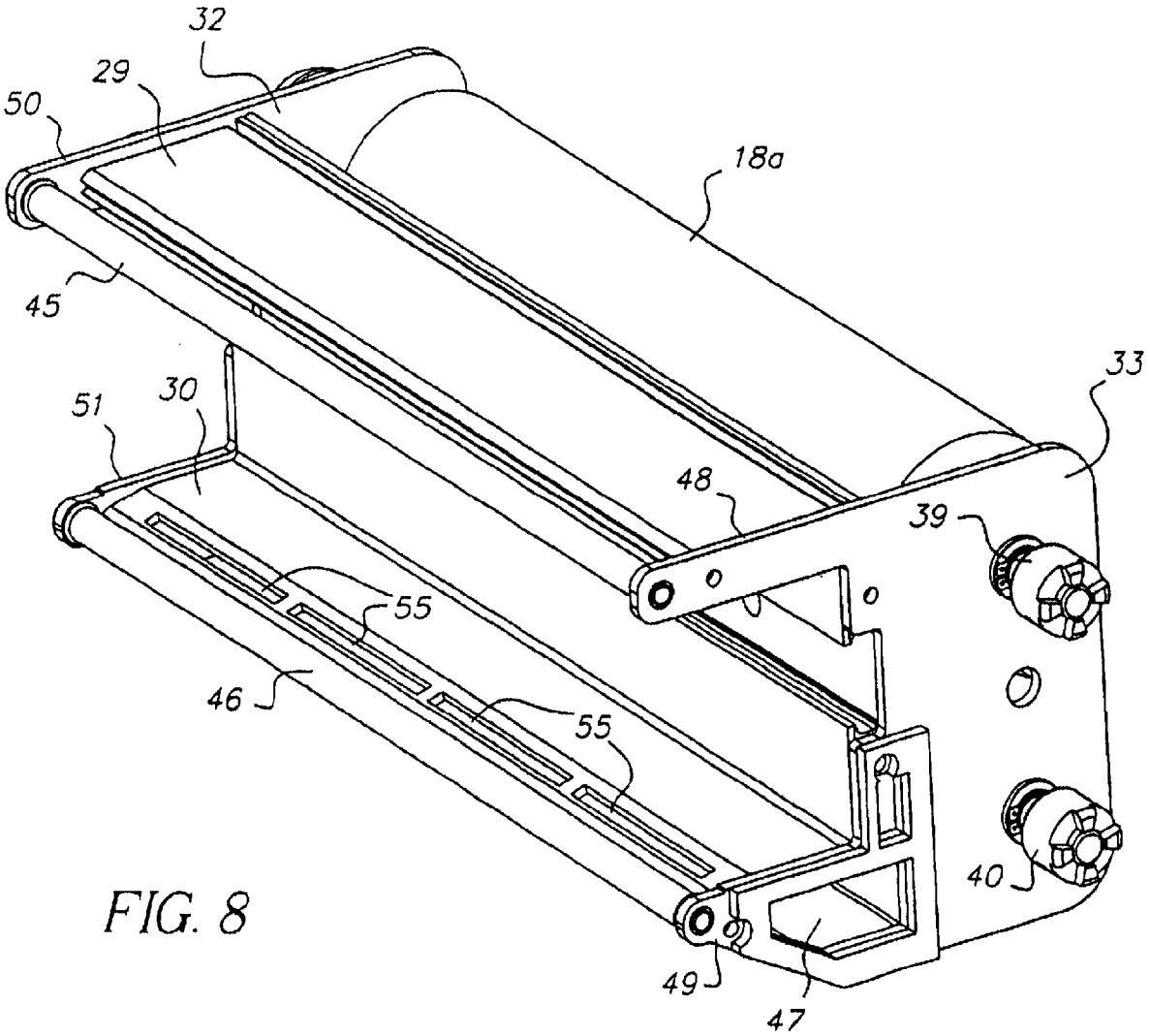

With reference now to FIGS. 3 and 5, there is shown the ribbon cassette assembly 28 mounted to the loading aid bracket 20. In FIG. 5, there is shown a close-up view of the ribbon cassette assembly 28 mounted on the loading aid bracket 20 with the supply and take-up rolls removed and ready to receive a new supply roll and take-up roll. In FIG. 7, the insert devices are shown in the form of gudgeons 35*r*, 35*f*, 36*r*, 36*f* that are spring-loaded to be received within the respective end of each core. With reference now to FIG. 8, still another view of the ribbon cassette assembly is shown and illustrating more clearly additional structures such as guide rollers 45, 46 about which the thermal ribbon is wrapped. The guide rollers 45, 46 are supported for rotation in respective openings in the depending legs 48, 49 associated with the rear plate 33 and depending legs 50, 51 associated with the front plate 32. Formed within the left sidewall 30 is a plenum chamber 47 into which air may be blown from a fan in the printer apparatus to distribute air to the respective print head associated with the ribbon cassette assembly. The air in the plenum exits from openings 55 in the wall 30 to impinge upon heat sinks associated with the print head.

Figure 9:
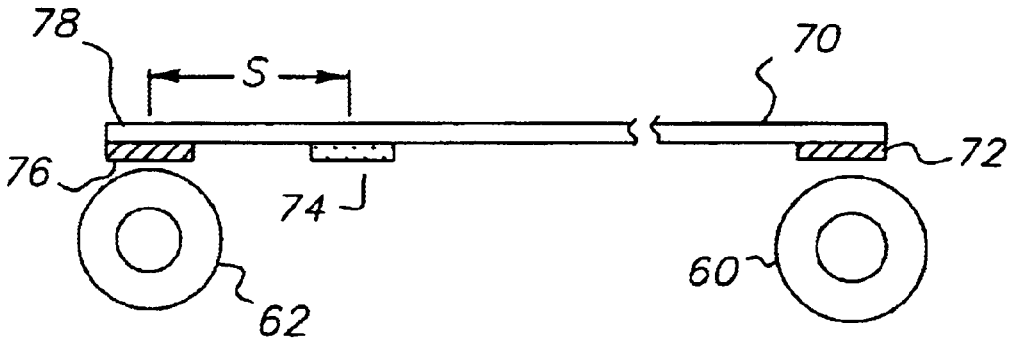
FIG. 9 is a schematic view showing parts of the ribbon take-up and supply rolls.
Figure 10:
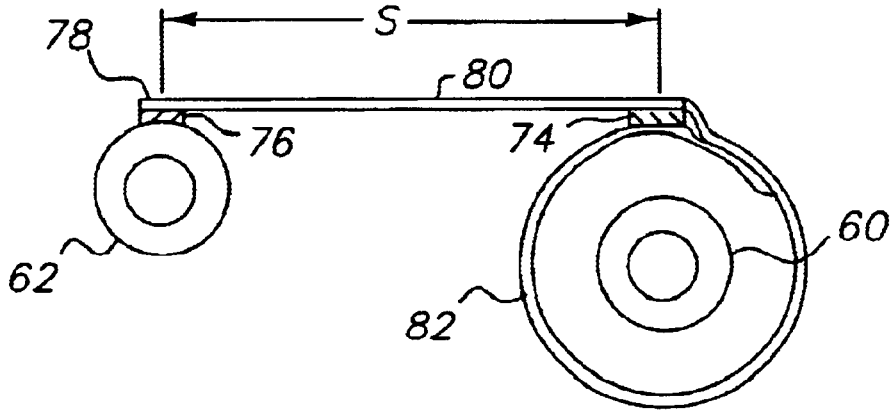
FIG. 10 is another schematic view showing the ribbon take-up and supply rolls.

With reference now to FIGS. 9 and 10, the supply and take-up rolls comprise respective cores 60, 62 for supporting the respective ribbon rolls. The supply includes a leader portion 80 that extends from an outer convolution 82 of the supply roll of thermal ribbon with a leading end portion 78 of the leader portion being attached to the take-up ribbon core 62 using a double sided tape that is of the "permanent" tied. A double sided tape piece 74 is attached to the leader portion 80 at a sufficient distance from the leading end portion 78 so as to adhesively couple the leader portion 80 to the outer convolution 82 of the take-up roll. The tape piece 74 is of the "removable" type so that the adhesive coupling between the outer convolution of the take-up roll and the leader portion is sufficiently strong so as to prevent unraveling of the thermal ribbon from the roll on the supply core when the take-up core is supported by an operator and the supply core with the complete roll of ribbon around thereon (but for the leader portion 80) is allowed to dangle freely. This could happen inadvertently where the operator, while holding the take-up core, drops the supply roll but there is no unwinding thereof due to the adhesive connection by the tape piece 74 to the leader portion and the outer convolution. It will be appreciated that the leader portion 80, including the leading end portion 78, is comprised of the ribbon material itself and this simplifies packaging of the thermal print of the ribbon by not requiring any leader to be attached to the ribbon to assist in mounting of the ribbon rolls to the ribbon cassette assembly. It will be understood that the terms permanent type tape and removable type tape are relative terms with regard to their particular functions, however it will be well understood that the permanent type tape makes sufficient engagement with the take-up core as to make it unlikely during normal use that there will be any separation between the leading end portion 78 and the take-up core 62 when they are joined by the tape piece 76. On the other hand it is expected that there will be separation between the outer convolution 82 of the supply roll and tape piece 74 when the operator desires to break the adhesive connection in the process of mounting the cores upon the ribbon cassette assembly. A permanent type tape piece 72 may also be attached to the trailing end of the thermal ribbon to securely attached the terminal end of the thermal print ribbon to the supply core 60.

With the cassette ribbon assembly 28 mounted and thus supported on the loading aid bracket 20, both hands of the operator are free to obtain the supply roll with the take-up core having the leading end portion of the ribbon attached thereto and to now mount the supply roll to the cassette ribbon assembly by urging one of the spring-loaded supply roll supporting devices 36*r*,36*f* rearwardly in the case of the rear support device or forwardly in case of the front support device so that the supply core may be received by these supports through spring bias upon the support devices being freed to move axially towards the core.

Although the leader portion 80 of the ribbon is attached to the outer convolution of the take-up roll by the double sided adhesive tape 74, the operator may relatively easily undo this adhesive attachment and wrap the ribbon about the right sidewall 29 and then the left sidewall 30 so that the take-up core is now in position to be mounted on the cassette ribbon assembly. The adhesive connection of the leading end 78 to the take-up core 62 is substantially greater than the adhesive connection of the double sided tape 74 to the outer convolution so that there is no danger of adhesion being lost between the leading end 78 and the take-up core 62 during mounting of the take-up and supply cores to the ribbon cassette assembly. The take-up roll supporting devices 35*r*, 35*f* are similarly constructed and spring-biased as that of the supply roll supporting devices to receive the take-up core. It is preferred to have the tape piece 74 located relative to the leading end portion 78 so that, when the ribbon cassette assembly with the newly inserted take-up and supply cores mounted thereto are input back into the printer apparatus, the tape piece 74 is positioned downstream of the print nip where the printer would engage the thermal ribbon so that the tape piece 74 does not contaminate or engage the receiver sheet or receiver media. The spacing S of about 3.5 inches is suitable in the example provided herein. The ribbon cassette assembly may now be removed from the loading aid bracket and then supported on the appropriate rails for sliding placement within the printer apparatus. In this regard, as is known, the ribbon cassette assembly may be provided with dovetail structure that engages the rails for the sliding movement. The platen assembly 9 is then retracted into its operative position for commencement of printing.

Figure 11:
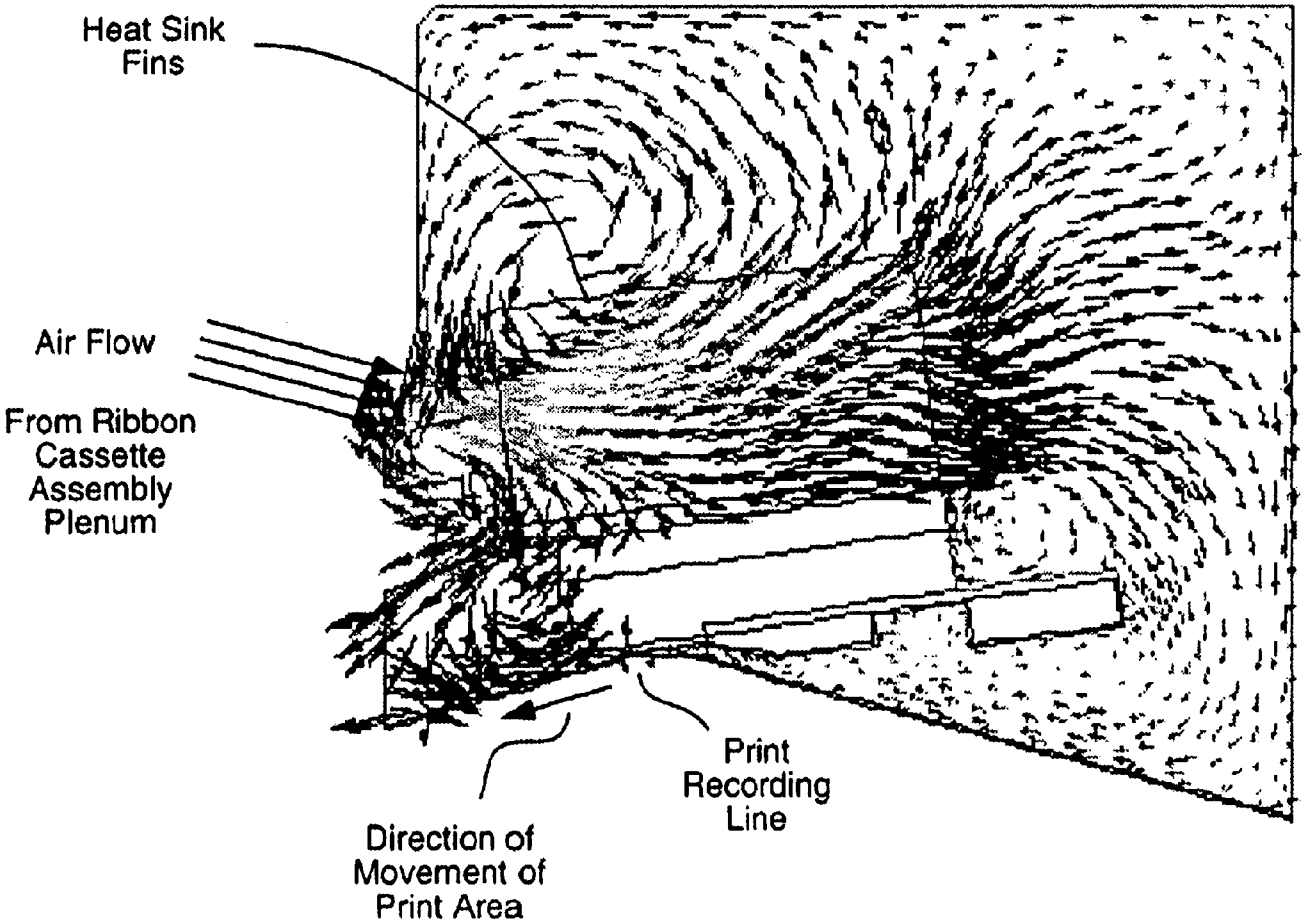
FIG. 11 is a schematic side elevational view illustrating airflow against a print head and a heat sink portion of the print head in accordance with the invention.

With reference now to FIG. 11, a schematic view is shown of the print head and heat sink associated therewith, the heat sink including a series of fins each of which extends transversely of the main scan recording direction. As shown in FIG. 11, airflow directionally from the ribbon cassette assembly plenum slot-like outlets is directed through the spacing between adjacent fins and importantly establishes an airflow that commences from a location of the fins closest to the print recording line so that substantial airflow is also provided at the print recording line also. The airflow along the fins is generally parallel to the process direction (sub-scan direction) of movement of the receiver media but due to the orientation and construction of the print head the direction of the airflow along the fins is generally opposite, but yet approximately parallel, to the direction of movement of the receiver media.

Figure 12:
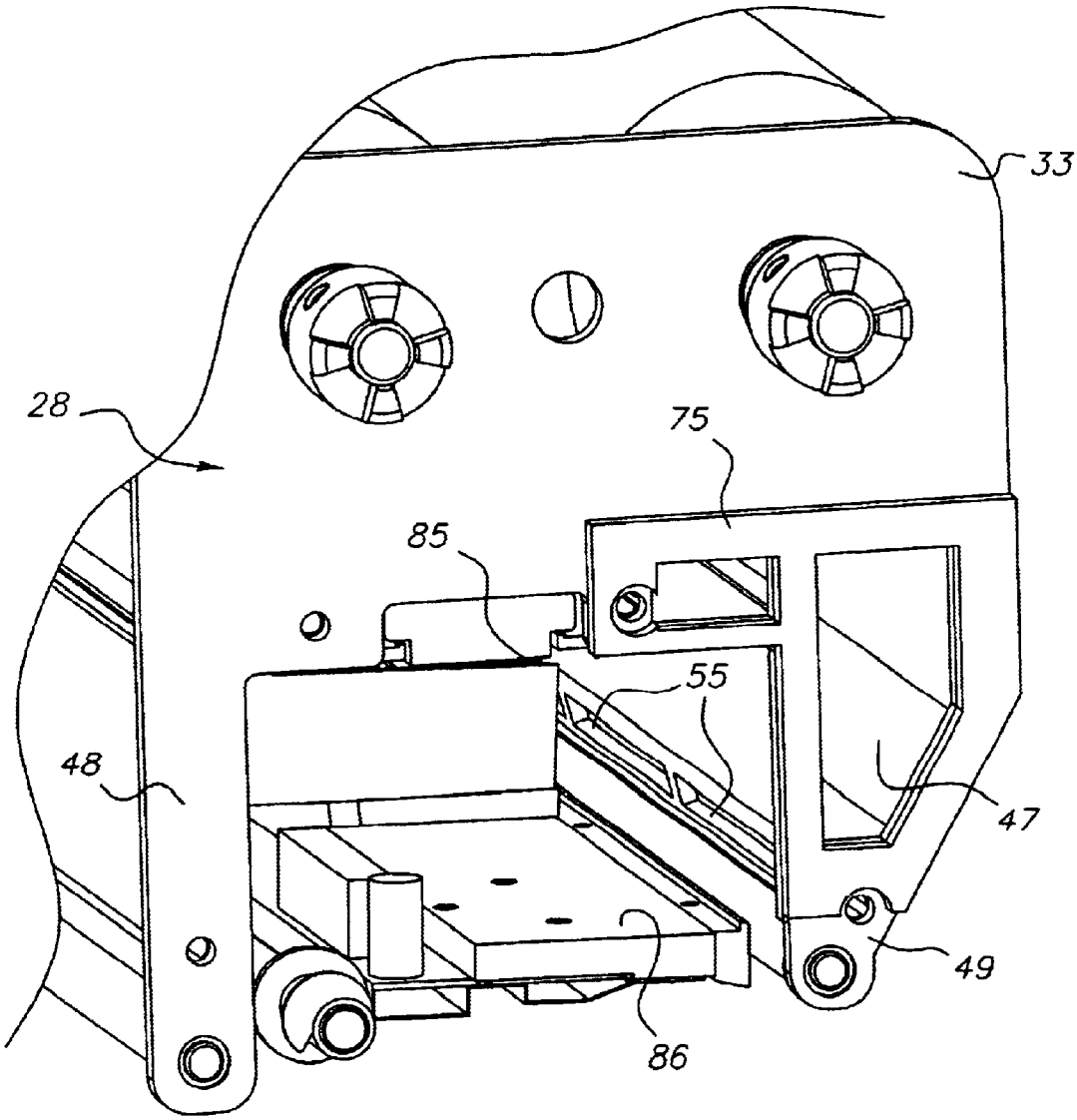
FIG. 12 is a partial view of a ribbon cassette assembly that includes an air plenum in accordance with the invention.
Figure 13:
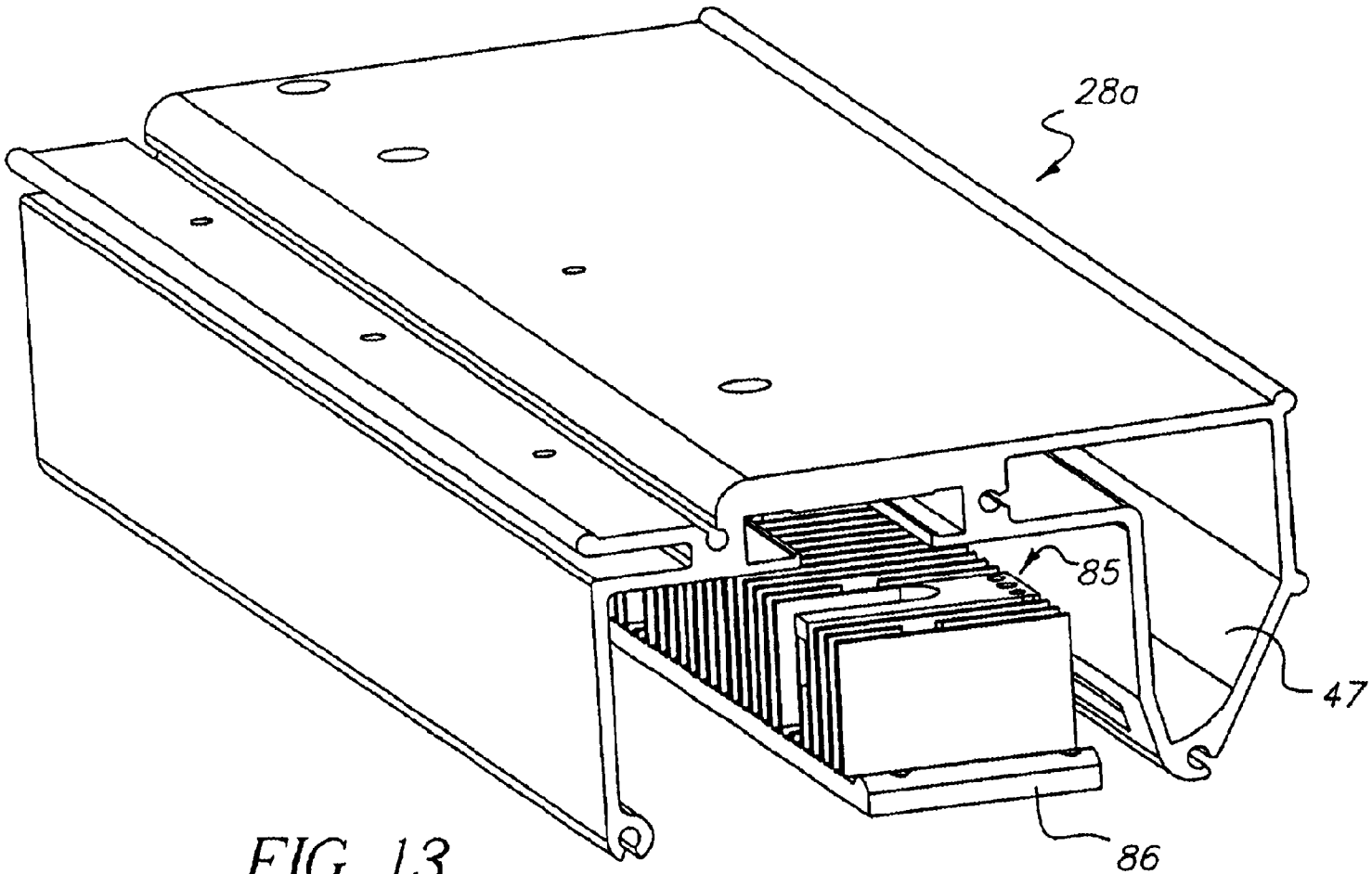
FIG. 13 is a view similar to that of FIG. 12 with the front and rear end plates removed to illustrate the center portion of the ribbon cassette assembly and showing more clearly relative location of the outlets of the plenum vis-a-vis fins on the heat sink associated with the print head.
Figure 14:
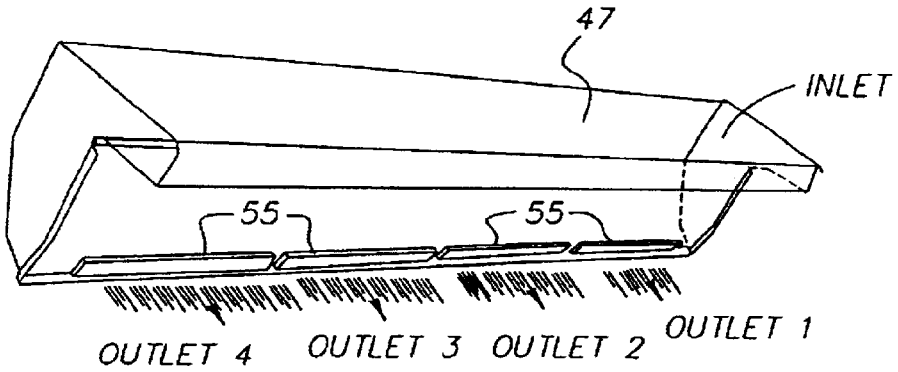
FIG. 14 is a schematic perspective view of a portion of the ribbon cassette assembly comprising the plenum.
Figure 15:
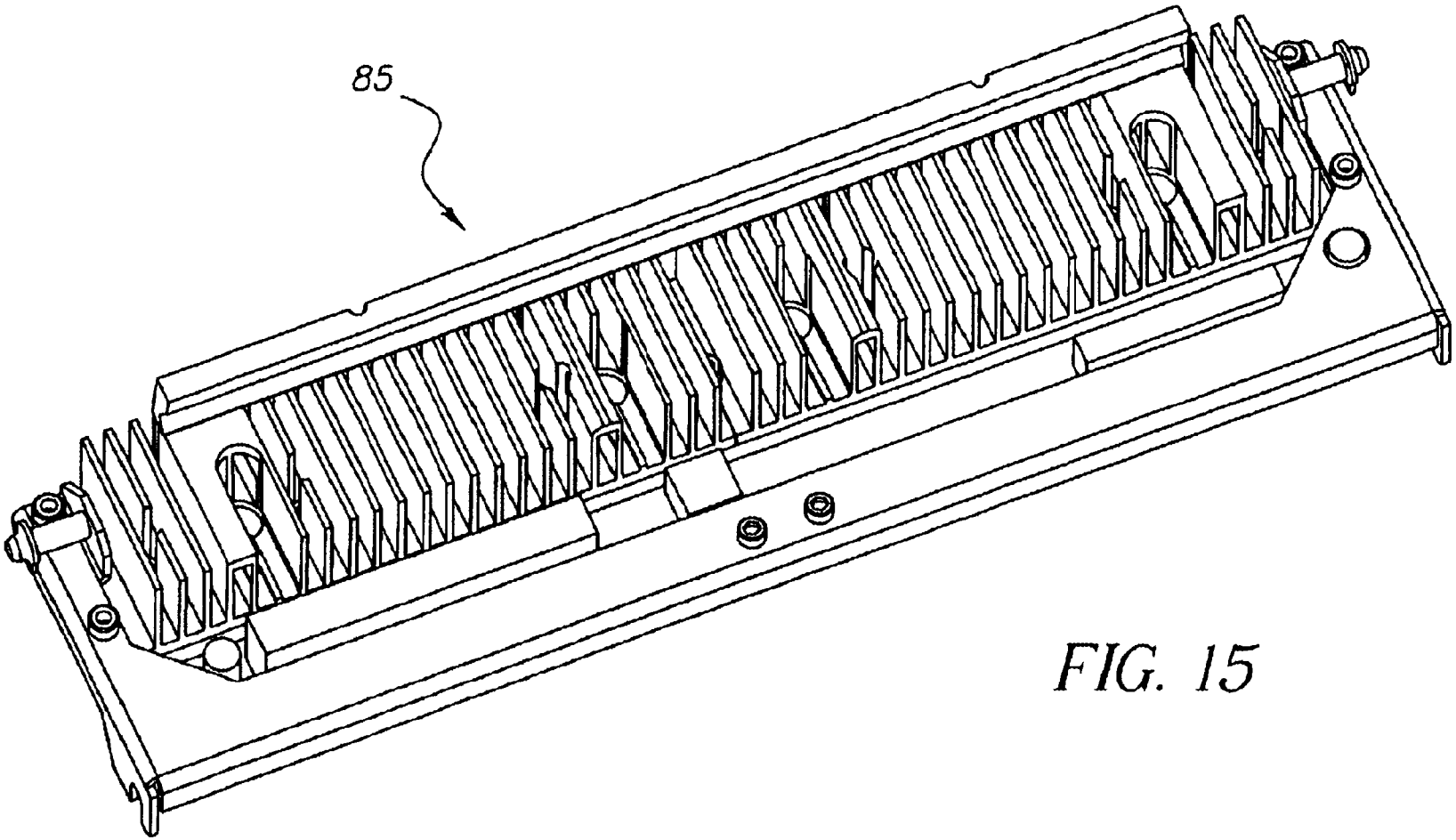
FIG. 15 is a perspective view of the fin assembly forming part of the heat sink associated with the print head.

With reference now to FIG. 12, each ribbon cassette assembly 28 has a plenum 47 that interfaces with a fan plenum to be discussed below and includes a gasket 75 mounted upon the end plate 33 to provide a sealing interface with the fan plenum. As noted above the ribbon cassette assembly plenum 47 has a series of slot-like openings 55 which openings are directed along the length or longitudinal extent of the print head and further directed to establish airflow along the heat sink fins. The slots may be a single slot or a plurality of slots as shown. With reference now to FIG. 13, the end plate 33 and other structures are shown removed to illustrate the extrusion, preferably made of aluminum, forming the central portion 28*a* of the ribbon cassette assembly 28 and to better illustrate the series of fins 85 attached to a heat sink plate 86. The fins and heat sink plate are formed of a conductive material such as metal and specifically aluminum. In FIG. 14 the plenum 47 is illustrated schematically and this figure show is the direction of air inlet from the fan plenum to be described below and the output directionality of the air from the slots 55. In FIG. 15, the entire series of fins 85 is illustrated to show that the series substantially extends the full longitudinal length of the print head.

Figure 16:
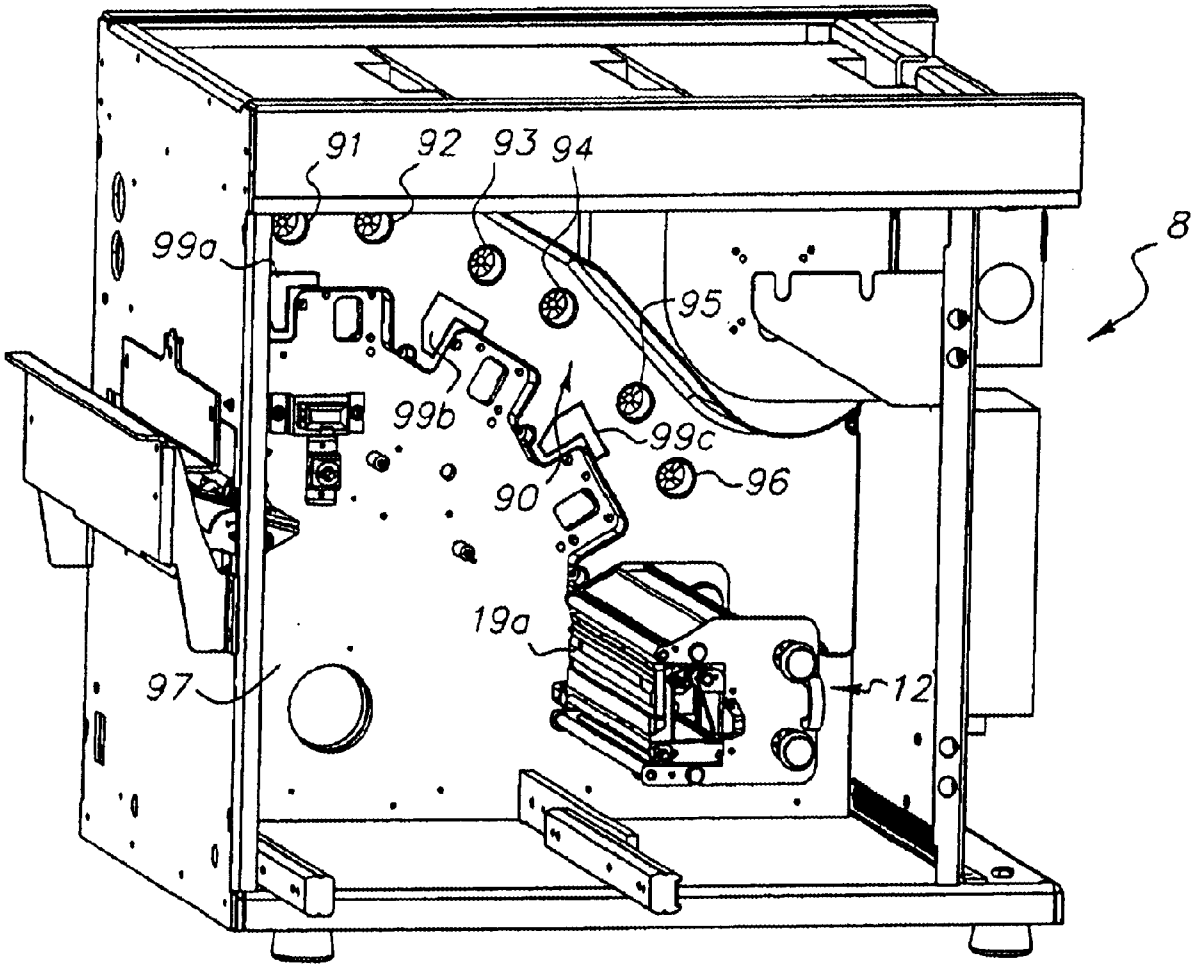
FIG. 16 is a perspective view of the printer apparatus with various members removed to share details of the fan plenum.
Figure 17:
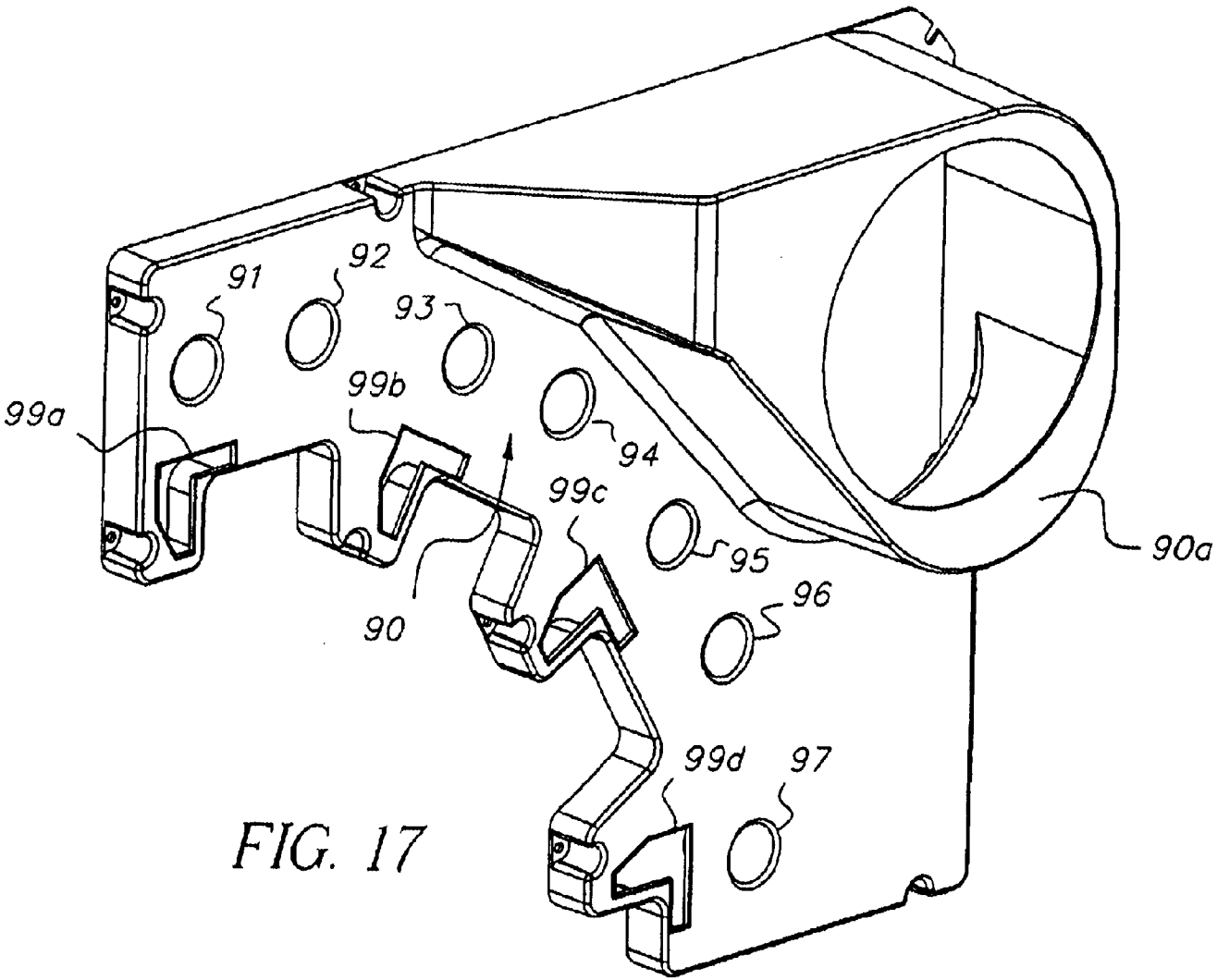
FIG. 17 is a perspective view of the fan housing and fan plenum.

With reference now to FIG. 16, the printer apparatus 8 is shown with various assemblies removed although one of the print assemblies 12 remains hanging in its operative position. The fan plenum 90 is now visible and comprises a narrow but extended plenum housing having a series of sealed ports 91–97 extending therethrough. The fan plenum 90 is attached to the mech plate 97 which is a bulkhead wall that extends vertically from the base of the printer apparatus 8 to near the top thereof. On one side of the mech plate 97 is the structure visible and shown in FIG. 16 and on the other side are various drive components such as gears and motor and other controls needed for operating a printer of this type. The gears 39, 40 on each of the ribbon cassette assemblies 28 extend through respective ports to engage gears similar to that of gears 39, 40 mounted on the other side of the mech plate 97. These gears are illustrated in FIG. 16 as being located at the end of each port. In FIG. 17 a detailed illustration of the fan plenum 90 including fan housing 90*a* is shown and in addition details of the air exit openings 99*a–d* from the fan plenum that engage the gasket 75 on the rear wall 33 of the ribbon cassette assembly. It will be noted that the sealed openings 91–97 represent posts within the fan plenum 90 about which fan blown air must travel around because air created by the fan cannot go through or out from these sealed ports. The fan is supported on the mech plate 97 within the fan housing 90*a* which housing communicates with the fan plenum 90 so that air generated by the fan travels through the fan plenum and exits from the air exit openings 99*a–d*. The fan is a variable speed fan whose fan speed is adjusted in accordance with temperature measured for the hottest print head.

Figure 18:
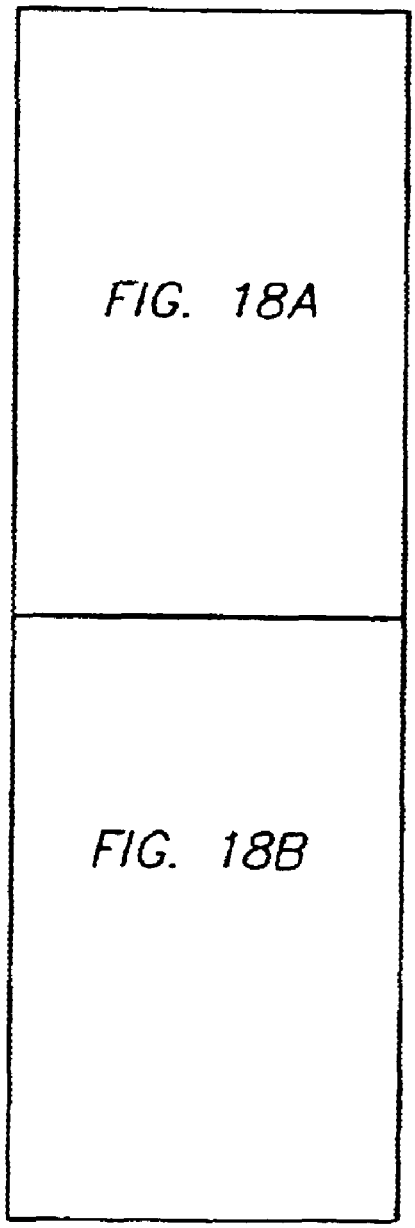
FIGS. 18, 18A and 18B is a flowchart for controlling temperature and operation of the print heads in accordance with the invention.
Figure 18A:
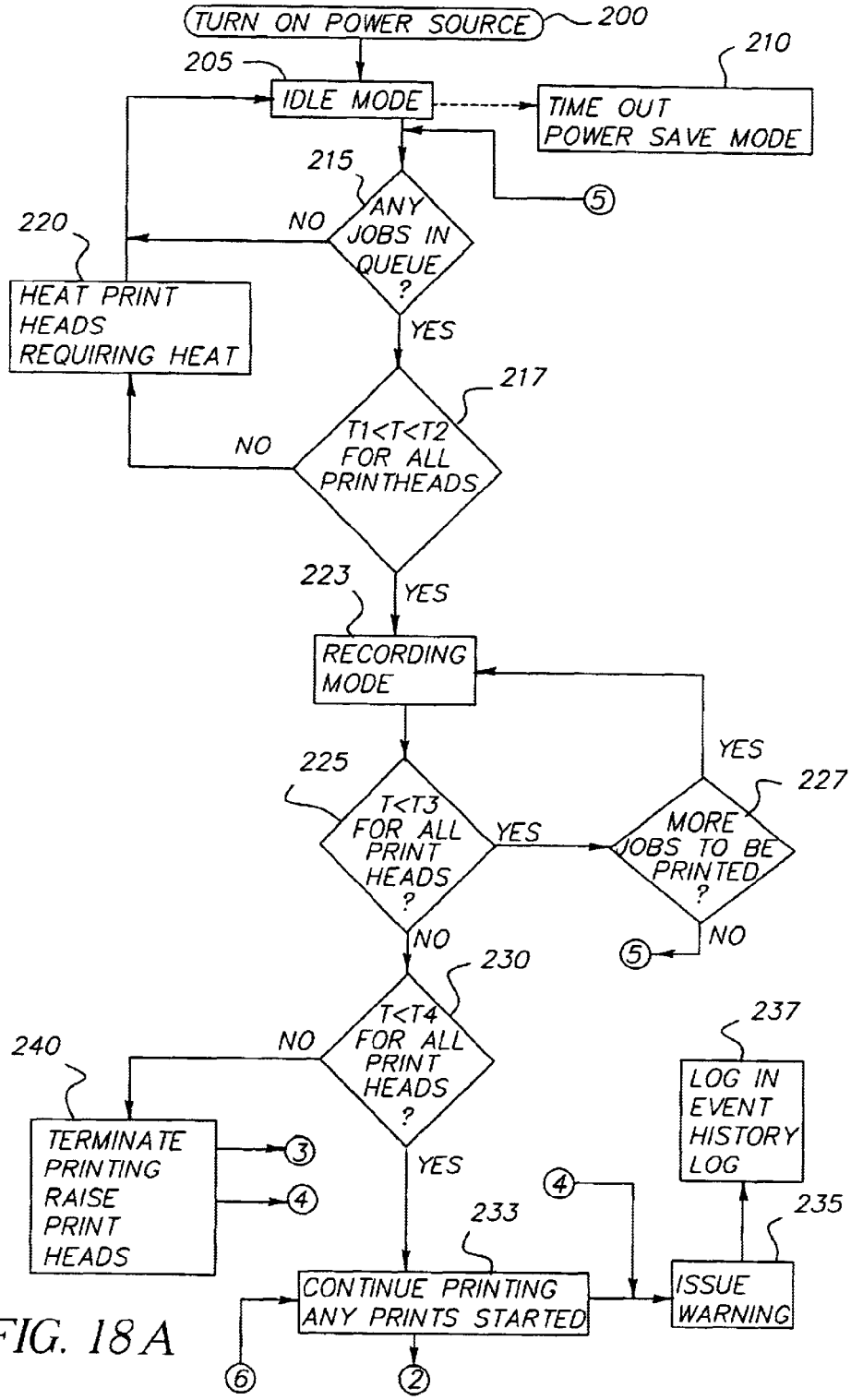
Figure 18B:
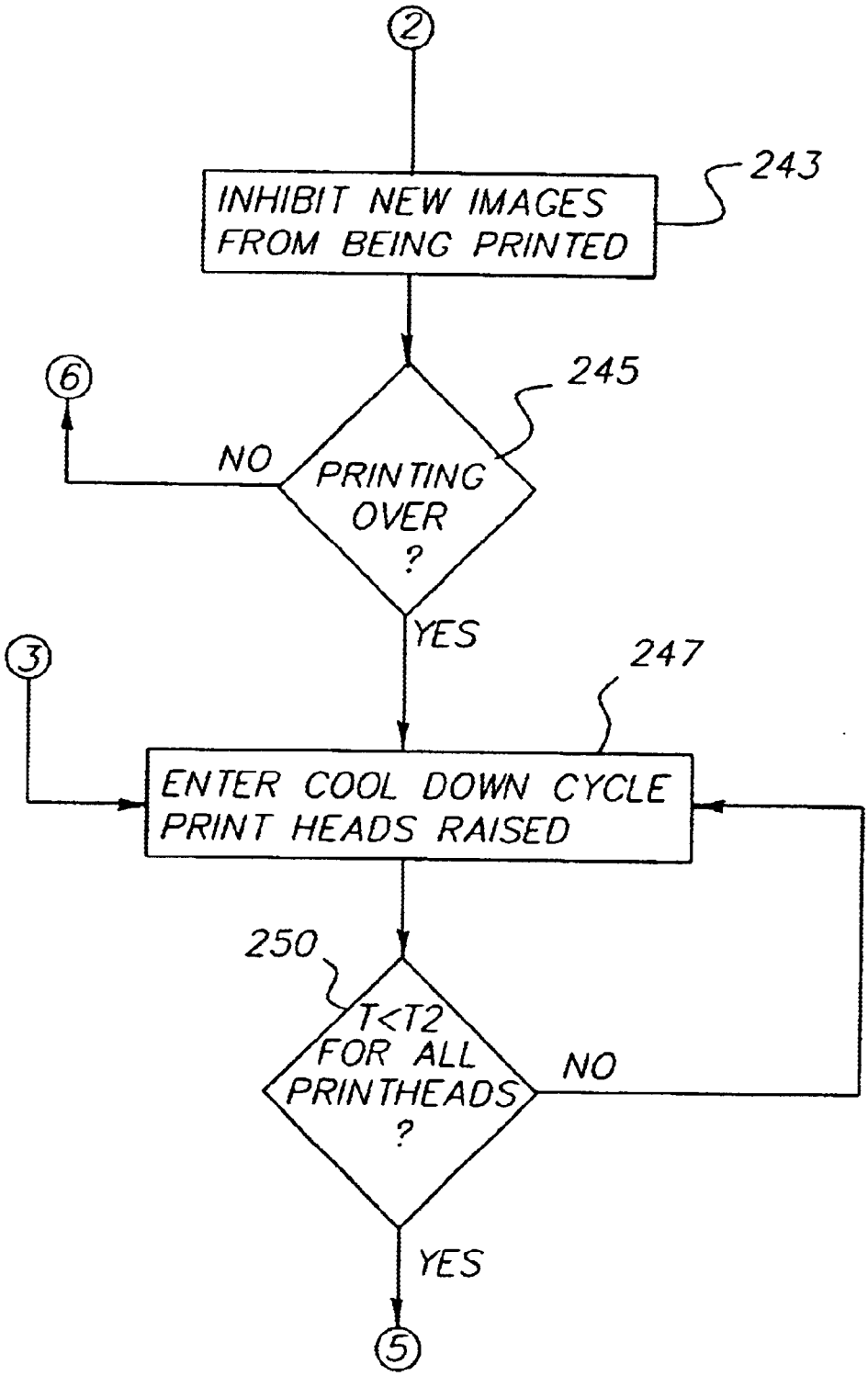

With reference now to the flowchart of FIGS. 18, 18A and 18B if the power source is turned on step 200 printer apparatus assumes an idle mode, step 205. A determination is made if any jobs are in the queue, step 212. If, after a predetermined time, no jobs are in the queue a timer times out and the printer apparatus enters a power save mode, step 210. If jobs are in the queue, temperature sensors on the print head have their respective outputs examined to determine for all the print heads whether their respective temperatures, T, are in the temperature range between T1 and T2, step 217, T2 being greater than T1. If the answer is no then heat is provided to the print heads requiring heat, step 220. Heat to print heads can be provided by sending driving current to all the respective recording elements of that print head as is well-known. If all the print heads are within operating temperature then the printer is free to enter a recording mode wherein images are recorded by moving the print heads to the recording position, step 223. If during recording the temperature of all print heads remain below a threshold temperature T3, which is greater than T2, printing may still continue, step 225 and 227. However, if any print head is above the threshold T3 examination is made to determine if it is below a threshold T4, which is greater than T3, step 230. If all the print heads temperatures are below the threshold T4, printing may continue of prints that have already been started, step 233. However, a warning is issued on a display identifying an overheating condition and that printing will terminate, step 235. In step 237, a log is made in an event history log and stored in a memory. In step 243, new images are inhibited from being printed. When the current image being printed is through printing, step 245, the print head enters a cool-down cycle wherein the print heads are raised away from respective print ribbons and the recording media, step 247. If, in step 230, any one of the print head's temperature is above the threshold temperature T4, printing terminates immediately and the print heads are raised and enter the cool down cycle, step 240. This event may also generate a warning to the operator as well as recordation of the event in the history log. When the print heads are in the cool-down cycle no printing is made until the temperatures for all the print heads are determined to be below the threshold value T2 at which time determination can be made as to whether or not to continue printing in accordance with the process steps noted above, step 250. Typical values for T1, T2, T3 and T4 are 30,40,65 and 70 degrees Centigrade, respectively.

Figure 19:
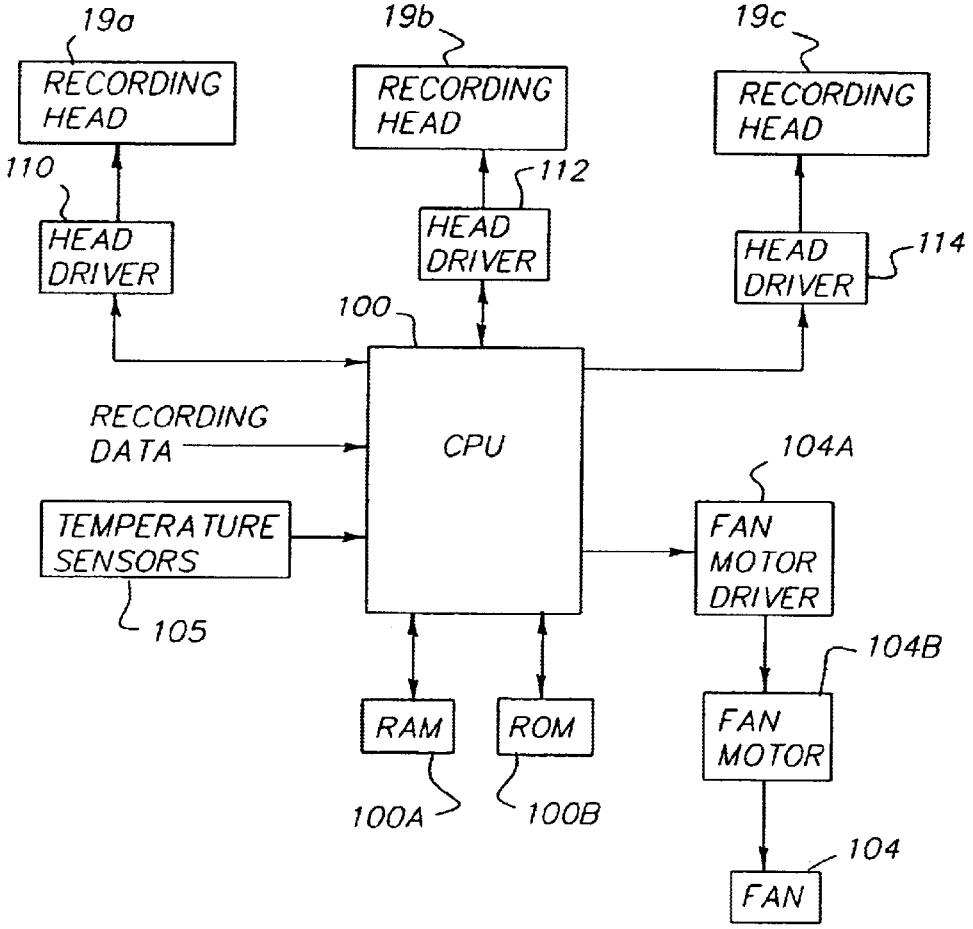
FIG. 19 is a schematic diagram of a control system for the printer apparatus.

With reference now to FIG. 19, overall control of the printer apparatus may be provided by a central processing unit (CPU) 100. Recording data may be input to the CPU or handled separately through an image data processing board that is controlled by the CPU. Temperature sensors 105 supported on each of the print heads provide signals to the CPU relative to their respective temperatures. The CPU is suitably programmed with programming instructions stored in a ROM memory 100B. A RAM memory 100A is also provided for storing various signals and instructions and tables used in control of the printer apparatus 8. The print or recording heads 19*a*, 19*b*, 19*c* and 19*d* are associated with respective recording head drivers 110,112, 114 and a similar driver (not shown) for the print head 19*d*. The print head drivers may be coupled to the CPU as shown or to a separate image data processing board. The CPU provides control over the fan 104 that is located in the fan housing 90*a* by providing suitable signals to a fan motor driver 104A that is connected to the fan motor 104B. Signals from the CPU for controlling the fan are in response to temperatures sensed by the sensors 105. As noted above, the fan can be driven at different speeds in accordance with the temperature condition of the hottest print head. The fan provides air under pressure to the fan plenum 90 and this plenum and thus the fan communicates with the ribbon cassette assembly plenum 47 to provide air under pressure to plenum 47.

The invention has been described in detail with particular reference to preferred embodiments thereof, but it will be understood that variations and modifications may be made in accordance with the spirit and scope of the invention.

What is claimed is:

1. A thermal printer apparatus for recording image information on moving receiver media at a print station, the apparatus comprising:

a ribbon cassette assembly for storing a thermal ribbon having dye, the thermal ribbon including a supply ribbon core and a take-up ribbon core, the cassette assembly including a supply ribbon support for supporting the supply ribbon core and a take-up ribbon support for supporting the take-up ribbon core, the cassette assembly including a wall structure defining a plenum chamber, the plenum chamber having air under pressure;

a fan communicating with the plenum chamber for providing air under pressure to the plenum chamber an elongated thermal print head positionable in engagement with the thermal ribbon for transferring dye from the thermal ribbon to the moving receiver media, the print head having a plurality of recording elements arranged in a main scan recording direction that is perpendicular to an advancement direction of the moving receiver media, the main scan recording direction also being the direction of elongation of the print head;

a heat sink associated with the print head and including a series of parallel fins arranged along the length of the print head and the fins being oriented at least generally perpendicular to the main scan direction, and generally parallel to the advancement direction of the receiver media; and wherein the wall structure extends in the direction of elongation of the print head and has one or more openings along the direction of elongation for providing cooling air directed generally to sweep in the direction of the fins so that the cooling air advances generally in a direction generally parallel to the advancement direction of the receiver media at the print station to enhance cooling of the print head.

2. The printer apparatus of claim 1 and wherein the printer apparatus is a multi-color printer apparatus and there are a plurality of such ribbon cassette assemblies and a respective plurality of such print heads each associated with a respective different said ribbon cassette assembly and each of said print heads has a respective different said heat sink associated therewith wherein for each of said ribbon cassette assemblies there is a said first wall structure that defines the plenum chamber having air under pressure and wherein the wall structure extends in the direction of elongation of the print head and has one or more openings along the direction of elongation for providing cooling air directed generally to sweep in the direction of the fins so that the cooling air advances generally in the direction generally parallel to the advancement direction of the receiver media at the print station to enhance cooling of the print head.

3. A method for recording image information on a moving receiver media at a thermal print station, the method comprising:

providing a ribbon cassette assembly that stores a thermal ribbon having dye, the thermal ribbon being supported as a supply roll and take-up roll on the ribbon cassette assembly, the ribbon cassette assembly including a wall structure defining a plenum chamber;

providing air under pressure to the plenum chamber;

providing an elongated thermal print head that is positioned in engagement with the thermal ribbon and activating recording elements on the thermal print head that are directed along a main scan direction to transfer dye on the thermal ribbon to the moving receiver media, the print head having associated therewith a heat sink that includes a series of parallel fins arranged along the length of the print head and the fins being oriented at least generally perpendicular to the main scan direction of printing; and providing cooling air from the wall structure, which structure extends in the direction of elongation of the print head and has one or more openings along the direction of elongation, the cooling air being directed generally to sweep in the direction of the fins so that the cooling air advances generally in a direction generally parallel to the advancement direction of the receiver media at the printing station.

4. The method of claim 3 and wherein there are plural of such print stations with a plurality of the ribbon cassette assemblies that store respective different color dye transfer ribbons and from a plenum from each of said ribbon cassette assemblies cooling air is provided from a wall structure that defines the plenum, which wall structure extends in the direction of elongation of a respective print head associated with that print station, and the cooling air being directed generally to sweep in the direction of fins that are arranged as a series arranged along the print head and the fins being oriented generally perpendicular to the main scan direction of printing for each print station.

5. The method of claim 4 and wherein said print stations are arranged along a path, each print station including a print head for recording a particular respective color image of a multi-color image at that station;

advancing the thermal recording media from print station to print station to record the respective color image at each respective print station;

prior to commencing recording of a multi-color image determining if all the print heads used in image recording are in a first temperature operating range and if all image recording print heads are in the first temperature operating range commencing recording of the multi-color image;

determining during image recording if any of the print heads used in image recording have exceeded a first temperature threshold that is outside of said first temperature operating range but is less than a second temperature threshold that is greater than said first temperature threshold; and if the temperature of a hottest print head used in image recording is greater than the first temperature threshold but less than the second temperature threshold, continuing recording to complete the multi-color image and after completing recording of the multi-color image inhibiting recording of further multi-color images until the temperatures of all the image recording print heads are in the first operating range.

6. The method according to claim 5 and wherein if the temperature of the hottest print head used in image recording is greater than the second temperature threshold, terminating recording without completing recording of the multi-color image being recorded.

7. The method of claim 3 and wherein there are plural of such print stations, the plural print stations being arranged along a path for recording a multi-color image, each print station including a print head for recording a particular respective color image of the multi-color image at that station;

advancing the thermal recording media from print station to print station to record the respective color image at each respective print station;

prior to commencing recording of the multi-color image determining if all the print heads used in image recording are in a first temperature operating range and if all image recording print heads are in the first temperature operating range commencing recording of the multi-color image;

determining during image recording if any of the print heads used in image recording have exceeded a first temperature threshold that is outside of said first temperature operating range but is less than a second temperature threshold that is greater than said first temperature threshold; and if the temperature of a hottest print head used in image recording is greater than the first temperature threshold but less than the second temperature threshold, continuing recording to complete the multi-color image and after completing recording of the multi-color image inhibiting recording of further multicolor images until the temperatures of all the image recording print heads are in the first operating range.

8. The method according to claim 7 and wherein if the temperature of the hottest print head used in image recording is greater than the second temperature threshold, terminating recording without completing recording of the multi-color image being recorded.

9. The printer apparatus of claim 1 and wherein the cooling air advances along the fins generally opposite to the direction of advancement of the receiver media.

10. The method of claim 3 and wherein the cooling air advances along the fins generally opposite to the direction of advancement of the receiver media.

* * * * *